US009252509B2

(12) United States Patent
Kato et al.

(10) Patent No.: US 9,252,509 B2
(45) Date of Patent: Feb. 2, 2016

(54) TERMINAL CONNECTION STRUCTURE FOR ELECTRIC CABLE

(71) Applicant: YAZAKI CORPORATION, Tokyo (JP)

(72) Inventors: Hajime Kato, Shizuoka (JP); Takaaki Miyajima, Shizuoka (JP)

(73) Assignee: YAZAKI CORPORATION, Tokyo (JP)

( * ) Notice: Subject to any disclaimer, the term of this patent is extended or adjusted under 35 U.S.C. 154(b) by 0 days.

(21) Appl. No.: 14/621,149

(22) Filed: Feb. 12, 2015

(65) Prior Publication Data

US 2015/0155644 A1 Jun. 4, 2015

Related U.S. Application Data

(63) Continuation of application No. PCT/JP2013/078362, filed on Oct. 18, 2013.

(30) Foreign Application Priority Data

Oct. 19, 2012 (JP) ..... 2012-231598

(51) Int. Cl.
*H01R 9/05* (2006.01)
*H01R 24/52* (2011.01)
(Continued)

(52) U.S. Cl.
CPC ..... *H01R 9/05* (2013.01); *H01R 9/0518* (2013.01); *H01R 13/6581* (2013.01); *H01R 13/6592* (2013.01); *H01R 13/6596* (2013.01); *H01R 24/52* (2013.01)

(58) Field of Classification Search
CPC ..... H01R 24/52; H01R 13/6592; H01R 13/6593; H01R 13/6596; H01R 9/05; H01R 13/6581
USPC ..... 438/580, 578, 579, 394, 620.03
See application file for complete search history.

(56) References Cited

U.S. PATENT DOCUMENTS 4,553,806 A * 11/1985 Forney, Jr. ..... H01R 24/562 439/277
4,799,902 A * 1/1989 Laudig ..... H01R 24/562 439/580

(Continued)

FOREIGN PATENT DOCUMENTS

JP 5-217635 A 8/1993
JP 8-055654 A 2/1996

(Continued)

OTHER PUBLICATIONS

International Search Report for PCT/JP2013/078362 dated Dec. 3, 2013.

(Continued)

*Primary Examiner* — Abdullah Riyami
*Assistant Examiner* — Harshad Patel
(74) *Attorney, Agent, or Firm* — Kenealy Vaidya LLP

(57) ABSTRACT

A terminal connection structure for an electric cable includes a first terminal connected to a part of an internal conductor which is exposed by peeling off a first insulating covering, a second terminal connected to a part of an external conductor which is exposed by peeling off a second insulating covering, and a housing member that surrounds an outer periphery of the first terminal and an outer periphery of the second terminal and contains the first terminal and the second terminal which are arranged coaxially in a separated manner.

1 Claim, 4 Drawing Sheets

(51) Int. Cl.

| | |
|---|---|
| ***H01R 13/6581*** | (2011.01) |
| ***H01R 13/6592*** | (2011.01) |
| ***H01R 13/6596*** | (2011.01) |

(56) References Cited

U.S. PATENT DOCUMENTS

| | | | | |
|---|---|---|---|---|
| 6,702,611 | B1 | 3/2004 | Miyazaki et al. | |
| 8,016,615 | B2 * | 9/2011 | Montena | H01R 9/05 439/580 |
| 8,287,315 | B2 * | 10/2012 | Montena | H01R 9/05 439/580 |
| 8,419,469 | B2 * | 4/2013 | Montena | H01R 9/0524 439/578 |
| 2002/0042228 | A1 | 4/2002 | Yoshioka | |

FOREIGN PATENT DOCUMENTS

| | | | |
|---|---|---|---|
| JP | 3024770 | U | 5/1996 |
| JP | 10-162899 | A | 6/1998 |
| JP | 2000-268922 | A | 9/2000 |
| JP | 2001-60481 | A | 3/2001 |
| JP | 2002-117947 | A | 4/2002 |
| JP | 2011-81957 | A | 4/2011 |

OTHER PUBLICATIONS

Written Opinion of the International Search Report for PCT/JP2013/078362 dated Dec. 3, 2013.

* cited by examiner

TERMINAL CONNECTION STRUCTURE FOR ELECTRIC CABLE

CROSS REFERENCE TO RELATED APPLICATION

This application is a continuation of PCT application No. PCT/JP2013/078362, which was filed Oct. 18, 2013 based on Japanese Patent Application (No. 2012-231598) filed on Oct. 19, 2012, the contents of which are incorporated herein by reference. Also, all the references cited herein are incorporated as a whole.

BACKGROUND

1. Technical Field

The present invention relates to a terminal connection structure for an electric cable.

2. Background Art

Conventionally, as an electric cable to be arranged in a place where shielding of electromagnetic waves or so is required (for example, inside an electric appliance of an automobile or the like), a coaxial electric cable has been widely used (Reference should be made to JP-A-2011-81957). The coaxial electric cable has such a structure that one or a plurality of internal conductors (core wires) are covered with a first insulating covering (an internal insulator), and an external conductor which is provided on an outer periphery of the internal insulator is covered with a second insulating covering (an external insulator). Moreover, such a structure that a shield conductor is provided on an outer periphery of the external insulator, and the shield conductor is covered with a third insulating covering (a protecting sheath) has been also known. End parts of these conductors are respectively connected to connection terminals at a side of the coaxial electric cable, and at the same time, connected to connection terminals, circuits, electric wires, and so on of a mating appliance to be connected via the connection terminals. In this manner, the coaxial electric cable is electrically continued to the mating appliance.

In case where the connection terminals at the side of the coaxial electric cable are connected to a plurality of the conductors in the coaxial electric cable, and the coaxial electric cable is connected to the connection terminals of the mating appliance to be connected via the connection terminals, there are arranged a plurality of the connection terminals in a terminal connection part of the coaxial electric cable. In this case, for example, in such a structure that two pieces of the internal conductors are drawn out in parallel and connected to the connection terminals at the side of the coaxial electric cable so as to be opposed to the connection terminals of the mating appliance to be connected, the two connection terminals are arranged in parallel in the terminal connection part of the coaxial electric cable. Therefore, the terminal connection part of the coaxial electric cable grows bulky in size, which makes a problem in attaining space saving of the connection structure for the coaxial electric cable.

Moreover, in case where an interval between the connection terminals which are arranged in parallel is not constant, there is such anxiety that deterioration of connection workability or deterioration of electrical continuity due to discordance of impedance may be incurred. In addition, in the same manner as the terminal connection part at the side of the coaxial electric cable, a terminal connection part in the mating appliance also grows bulky in size. Therefore, in order to attain the space saving of the connection structure of this type, the terminal connection part in the mating appliance too must be taken into consideration.

This invention has been made in view of the problems as described above, and an object of the invention is to provide a terminal connection structure for an electric cable in which a terminal connection part of the electric cable (a coaxial electric cable) can be made compact in size, and connection workability and electrical continuity performance can be enhanced.

SUMMARY

The above described object of the invention is achieved by the following structures.

(1) A terminal connection structure for an electric cable which includes an internal conductor covered with a first insulating covering, and an external conductor surrounding an outer periphery of the first insulating covering and covered with a second insulating covering, the external conductor being arranged coaxially with the internal conductor, the terminal connection structure being connected respectively to the internal conductor and the external conductor, the terminal connection structure including: a first terminal connected to a part of the internal conductor which is exposed by peeling off the first insulating covering; a second terminal having a cylindrical shape surrounding an outer periphery of the first terminal and connected to a part of the external conductor which is exposed by peeling off the second insulating covering; and a housing member that surrounds the outer periphery of the first terminal and an outer periphery of the second terminal, and contains the first terminal and the second terminal which are arranged coaxially in a separated manner.

According to the terminal connection structure for the electric cable having the structure as described above in (1), it is possible to arrange a plurality of the terminals coaxially at a constant interval, thereby to make the terminal connection part of the electric cable compact in size. As the results, connection workability of the electric cable and electrical continuity performance can be enhanced.

(2) The terminal connection structure for the electric cable as described above in (1), which includes a shield conductor surrounding an outer periphery of the second insulating covering and covered with a third insulating covering, the shield conductor being arranged coaxially with the internal conductor and the external conductor, and a shield member connected to a part of the shield conductor which is exposed by peeling off the third insulating covering, wherein the shield member surrounds an outer periphery of the housing member, and wherein the exposed part of the shield conductor is arranged on an outer periphery of the shield member, and the exposed part of the shield conductor is connected by press-fitting to an outer peripheral face of the shield member by a ring member which is covered on an outer periphery of the exposed part of the shield conductor.

BRIEF DESCRIPTION OF THE DRAWINGS

FIGS. 1A and 1B are views showing an entirety of a terminal connection structure for an electric cable according to an embodiment of the invention, of which FIG. 1A is a perspective view showing the terminal connection structure in a state exploded into constituent members, and FIG. 1B is a perspective view showing the entirety in a state where the constituent members as shown in FIG. 1A are assembled.

FIGS. 3A and 3B are views showing an entire structure of a terminal member (a terminal table) in a mating appliance to be connected, of which FIG. 3A is a perspective view of the terminal table in a state exploded into constituent members, and FIG. 3B is a perspective view showing the entire structure in a state where the constituent members as shown in FIG. 3A are assembled.

DETAILED DESCRIPTION OF THE EXEMPLARY EMBODIMENTS

The terminal connection structure for the electric cable according to the invention (hereinafter, simply referred to as the terminal connection structure) will be described referring to the attached drawings. This invention relates to the terminal connection structure for the electric cable which includes an internal conductor covered with a first insulating covering, and an external conductor surrounding an outer periphery of the first insulating covering and covered with a second insulating covering coaxially with the internal conductor, in which the terminal connection structure are connected respectively to the internal conductor and the external conductor. As the electric cable of this type, it is possible to suppose a coaxial electric cable which is used as the electric cable to be arranged in a place where shielding of electromagnetic waves or so is required (for example, inside an appliance in an automobile or the like). However, use of the electric cable according to the invention is not limited to this case.

Figure 1A:
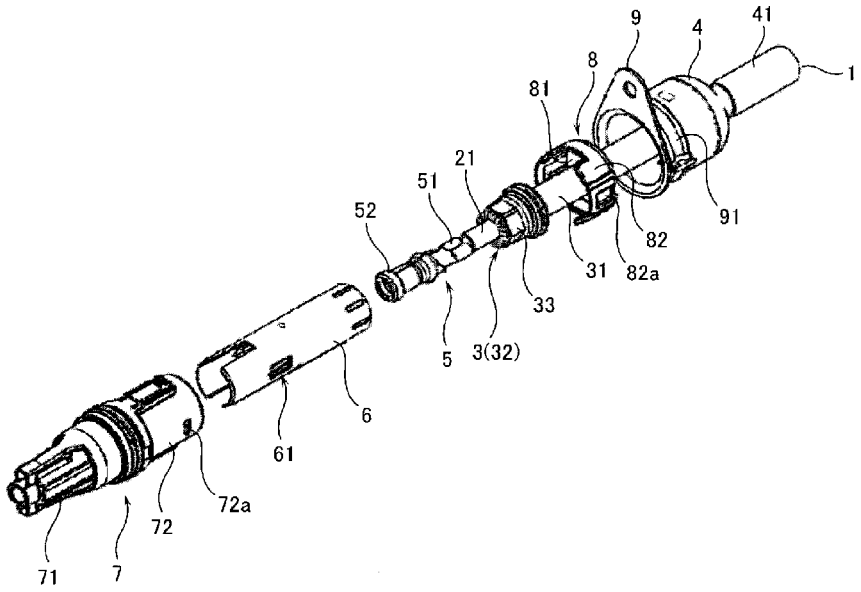
Figure 1B:
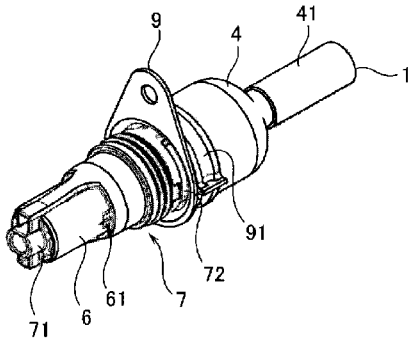
Figure 2:
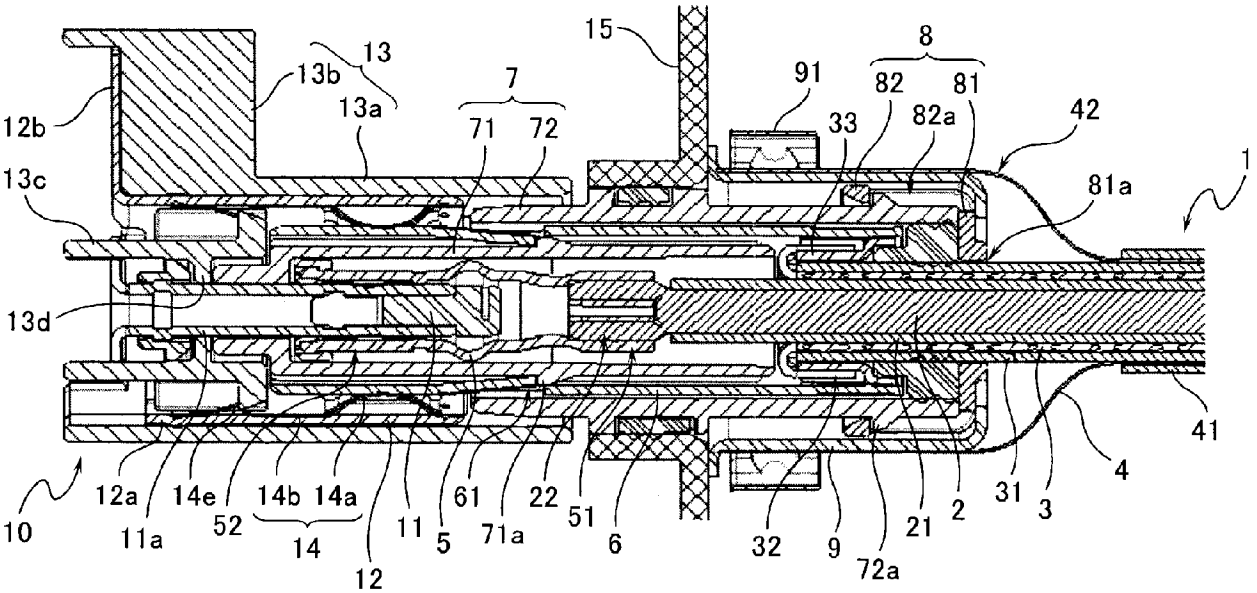
FIG. 2 is a longitudinal sectional view showing the terminal connection structure for the electric cable according to the embodiment of the invention.

As shown in FIGS. 1A and 2, the electric cable 1 according to this embodiment includes an internal conductor 2 which is covered with a first insulating covering (hereinafter referred to as an internal insulator) 21, and an external conductor 3 surrounding an outer periphery of the internal insulator 21 and covered with a second insulating covering (hereinafter referred to as an external insulator) 31 coaxially with the internal conductor 2. The electric cable 1 is further provided with a shield conductor 4 surrounding an outer periphery of the external insulator 31 and covered with a third insulating covering (hereinafter referred to as a protecting sheath) 41 coaxially with the internal conductor 2 and the external conductor 3. In this case, it is possible to form the internal conductor 2, the external conductor 3 and the shield conductor 4 in a desired manner. For example, the internal conductor 2 and the external conductor 3 can be supposed to be in a form of twisted wires, and the shield conductor 4 can be supposed to be in a form of braided wires or foils. Moreover, the internal insulator 21, the external insulator 31, and the protecting sheath 41 are formed of insulating material (for example, resin such as polyethylene, polyvinyl chloride, silicone). Specifically, the electric cable 1 is formed as a so-called coaxial electric cable (the coaxial cable of three layers) which is favorably used in a place where shielding of electromagnetic waves or so is required. In this embodiment, as an example, it is supposed that the electric cable 1 is an electric cable of two poles having the internal conductor 2 at a positive potential (a positive pole) and the external conductor 3 at a negative potential (a negative pole), alternatively, having the internal conductor 2 at the negative potential and the external conductor 3 at the positive potential, and that the electric cable 1 is used in a direct current circuit. It is also possible to suppose that the electric cable 1 is formed as a three-pole electric cable including a plurality of internal conductors to be used in a three-phase alternating current circuit, a single-phase three line circuit or the like.

The terminal connection structure in this embodiment includes a first terminal (hereinafter referred to as an internal conductor terminal) 5 which is connected to a part of the internal conductor 2 which is exposed by peeling off the internal insulator 21, a second terminal (hereinafter referred to as an external conductor terminal) 6 having a cylindrical shape surrounding an outer periphery of the internal conductor terminal 5 and connected to a part of the external conductor 3 which is exposed by peeling off the external insulator 31, and a housing member (hereinafter referred to as a terminal housing) 7 which surrounds an outer periphery of the internal conductor terminal 5 and an outer periphery of the external conductor terminal 6, and contains the internal conductor terminal 5 and the external conductor terminal 6 coaxially in a separated manner. It is to be noted that in the following description, a side where the internal conductor terminal 5 and the external conductor terminal 6 are connected (the left side in FIG. 2) with respect to an extending direction of the electric cable 1 (a lateral direction in FIG. 2) is referred to as an extreme end side, and an opposite side thereto (the right side in FIG. 2) is referred to as a base end side.

The internal conductor terminal 5 has a press-fitting part 51 to which the internal conductor 2 is connected by press-fitting, and an opening 52 to which a first terminal of a mating appliance to be connected (a terminal table internal terminal) 11, which will be described below, is adapted to be inserted and connected. The press-fitting part 51 is connected by press-fitting to an end part 22 of the internal conductor 2 from which the internal insulator 21 is peeled off, in a manner of clamping the end part 22. The opening 52 is formed in a substantially cylindrical shape having an inner diameter which is set to be slightly larger than an outer diameter of the aforesaid first terminal of the mating appliance. The internal conductor terminal 5 is so constructed as to be connected to the aforesaid first terminal, when the first terminal is inserted into a cylindrical part of the opening 52 and engaged therewith.

The external conductor terminal 6 is formed in a substantially cylindrical shape having an inner diameter which is set to be larger than a largest diameter part of the internal conductor terminal 5 (specifically, a largest diameter part of the opening 52), and has such a structure as capable of containing the internal conductor terminal 5 (that is, the press-fitting part 51 and the opening 52) inside the cylindrical shape (in short, such a structure as capable of surrounding an outer periphery of the internal conductor terminal 5). The external conductor terminal 6 may be formed by folding a conductive flat plate into a cylindrical shape. Moreover, a ring member 33 is covered and fixed to the external conductor 3 to which the external conductor terminal 6 is connected, at a position back from an end part 32 where the external insulator 31 is peeled off (specifically, an outer peripheral part of the external insulator 31 at the base end side than the end part 32). The end part 32 is folded back from an edge of the ring member 33, and the end part 32 which is folded back is positioned on an outer periphery of the ring member 33. The ring member 33 is a member having an inner diameter which is larger than a diameter of the electric cable 1 (that is, the protecting sheath 41), and capable of being easily deformed so as to be reduced in diameter, by crimping its outer peripheral part over an entire circumference thereof. For example, a metal ring can be used as the ring member 33. In this case, the inner diameter of the external conductor terminal 6 is set to be substantially equal to that of the folded back part of the end part 32.

Therefore, by inserting the external conductor terminal 6 over the end part 32 from a direction where the end part is folded back, that is, the extreme end side of the electric cable 1 (the left side in FIG. 2 as an example), the external conductor terminal 6 can be tightly fitted to the end part 32. In this manner, the external conductor terminal 6 is connected to the external conductor 3.

The terminal housing 7 has a double cylinder structure in which a cylindrical part (hereinafter, referred to as an inner cylindrical part) 71 having an inner diameter which is set to be larger than the largest diameter part of the internal conductor terminal 5 (specifically, the largest diameter part of the opening 52), and an outer diameter which is set to be smaller than the diameter of the external conductor terminal 6, and a cylindrical part (hereinafter, referred to as an outer cylindrical part) 72 having an inner diameter which is set to be larger than the diameter of the external conductor terminal 6 are arranged coaxially. Because the terminal housing 7 has the double cylinder structure as described above, the outer periphery of the internal conductor terminal 5 is surrounded by the inner cylindrical part 71, and the outer periphery of the external conductor terminal 6 is surrounded by the outer cylindrical part 72. In this state, it is possible to interpose the inner cylindrical part 71 between the internal conductor terminal 5 and the external conductor terminal 6 (that is, an outer peripheral side of the internal conductor terminal 5), and at the same time, it is possible to position the outer cylindrical part 72 at an outer peripheral side of the external conductor terminal 6. In this manner, the terminal housing 7 is so constructed that the internal conductor terminal 5 and the external conductor terminal 6 which are arranged coaxially can be separated by the inner cylindrical part 71, and all of them can be contained in the outer cylindrical part 72. Accordingly, in a state contained in the terminal housing 7, the internal conductor terminal 5 and the external conductor terminal 6 are arranged in a manner separated from each other at a constant interval. Therefore, it is possible to effectively prevent occurrence of troubles such as a short circuit due to contact between them, and at the same time, it is possible to easily perform impedance matching.

On occasion of containing the internal conductor terminal 5 and the external conductor terminal 6 in the terminal housing 7, the terminal housing 7 has only to be moved from the extreme end side toward the internal conductor terminal 5 and the external conductor terminal 6, in a state where the internal conductor terminal 5 is connected to the internal conductor 2 and the external conductor terminal 6 is connected to the external conductor 3, thereby to allow the inner cylindrical part 71 to be interposed between the internal conductor terminal 5 and the external conductor terminal 6 (at the outer peripheral side of the internal conductor terminal 5), and to allow the outer cylindrical part 72 to be positioned at the outer peripheral side of the external conductor terminal 6. In this case, the inner cylindrical part 71 of the terminal housing 7 is provided with a locking part (hereinafter referred to as an inner locking part) 71*a* projecting from an outer peripheral face thereof. By engaging the inner locking part 71*a* with a locking groove 61 which is formed on the external conductor terminal 6, it is possible to position the external conductor terminal 6 with respect to the inner cylindrical part 71 (that is, the terminal housing 7). The locking groove 61 is formed by a step difference between an inner peripheral face of the external conductor terminal 6 and an inclined part of the inner peripheral face at an intermediate position in an axial direction, which is gradually reduced in diameter from the extreme end side to the base end side to be inclined in a taper shape. When the terminal housing 7 is moved from the extreme end side to the base end side for the purpose of containing the internal conductor terminal 5 and the external conductor terminal 6 in the terminal housing 7, the inner locking part 71*a* moves along the inclined part of the inner peripheral face of the external conductor terminal 6, in contact with the inclined part, to be engaged with the locking groove 61 at a distal end of the inclined part. For this purpose, a part of the inner locking part 71*a* to be contacted with the inclined part of the inner peripheral face of the external conductor terminal 6 is so formed as to be inclined in a taper shape from the extreme end side to the base end side. Moreover, when the inner locking part 71*a* comes into contact with the inclined part of the inner peripheral face of the external conductor terminal 6, the inclined part is elastically flexed and deformed so as to spread outward, and after the inner locking part 71*a* has been engaged with the locking groove 61, the inclined part is elastically flexed and restored so as to be drawn inward.

The internal conductor terminal 5 and the external conductor terminal 6 which are contained in the terminal housing 7 are prevented from falling from the terminal housing 7 by means of a holder member (hereinafter referred to as a rear holder) 8. The rear holder 8 is provided with a bottom part 81 having a through hole 81*a* through which the external insulator 31 of the electric cable 1 is passed, and a wall part 82 in a cylindrical shape which is extended from the bottom part 81 to the extreme end side. The through hole 81*a* has a hole diameter which is slightly larger than an outer diameter of the external insulator 31. The wall part 82 is provided with an opening 82*a* to be locked to a locking part (hereinafter referred to as an outer locking part) 72*a* which is projected from the outer peripheral face 72 of the terminal housing 7. Accordingly, by engaging the outer locking part 72*a* with an edge of the opening 82*a*, it is possible to position and fix the terminal housing 7 and the rear holder 8 with respect to the electric cable 1, and it is possible to prevent the internal conductor terminal 5 and the external conductor terminal 6 from falling from the terminal housing 7. As the results, it is possible to easily assemble the internal conductor terminal 5, the external conductor terminal 6, and the terminal housing 7 integrally, while reducing fixing points in number.

The rear holder 8 had better be kept in such a state that the external insulator 31 is inserted into the through hole 81*a* of the bottom part 81 in advance, before the internal conductor terminal 5 is connected to the internal conductor 2 of the electric cable 1, and the external conductor terminal 6 is connected to the external conductor 3. During connection work of the internal conductor terminal 5 and the external conductor terminal 6 to the internal conductor 2 and the external conductor 3, the rear holder 8 is kept retreated to the base end side than the end part 32 of the external conductor 3. Then, after the internal conductor terminal 5 and the external conductor terminal 6 are respectively connected to the internal conductor 2 and the external conductor 3 and contained in the terminal housing 7, the rear holder 8 is moved to the extreme end side along the external insulator 31, thereby allowing the outer locking part 72*a* of the terminal housing 7 to be engaged with the opening 82*a*. For this purpose, a peripheral edge of the wall part 82 and a butting face of the outer locking part 72*a* are inclined so as to match with each other, in order that the peripheral edge of the wall part 82 may be butted against and easily run upon the outer locking part 72*a*, when the rear holder 8 is moved toward the extreme end side. In this manner, the wall part 82 which is butted against the outer locking part 72*a* is elastically flexed and deformed to spread outward and runs upon the outer locking part 72*a*. Thereafter, the wall part 82 is elastically flexed and deformed to be restored, after the outer locking part 72*a* has entered into the opening 82*a*. As the results, the outer locking part 72*a* can be engaged with the edge of the opening 82*a*.

Moreover, in the terminal connection structure according to the embodiment, the electric cable 1 is in a state where the shield conductor 4 is exposed by peeling off the protecting sheath 41, and a shield member (hereinafter referred to as a shield shell) 9 is connected to an exposed part (an end part 42) of the shield conductor 4. the shield shell 9 is formed as a case member for shielding the terminal housing 7 (that is, a terminal connection part of the electric cable 1), by surrounding an outer periphery of the outer cylindrical part 72 of the terminal housing 7 in which the internal conductor terminal 5 and the external conductor terminal 6 are contained. The electric cable 1 is fixed to a predetermined mating appliance to be connected (for example, an electric appliance mounted on an automobile) by way of the shield shell 9. In this case, the exposed part (that is, the end part 42) of the shield conductor 4 from which the protecting sheath 41 is peeled off is so arranged as to be placed on an outer periphery of the shield shell 9, and connected by press-fitting to an outer peripheral face of the shield shell 9 by means of a ring member 91 which is mounted on an outer periphery of the exposed part. The shield shell 9 is fixed to the mating appliance to be connected, and can conduct shielding treatment of the electric cable 1, when the shield conductor 4 is grounded by way of the mating appliance.

Figure 3A:
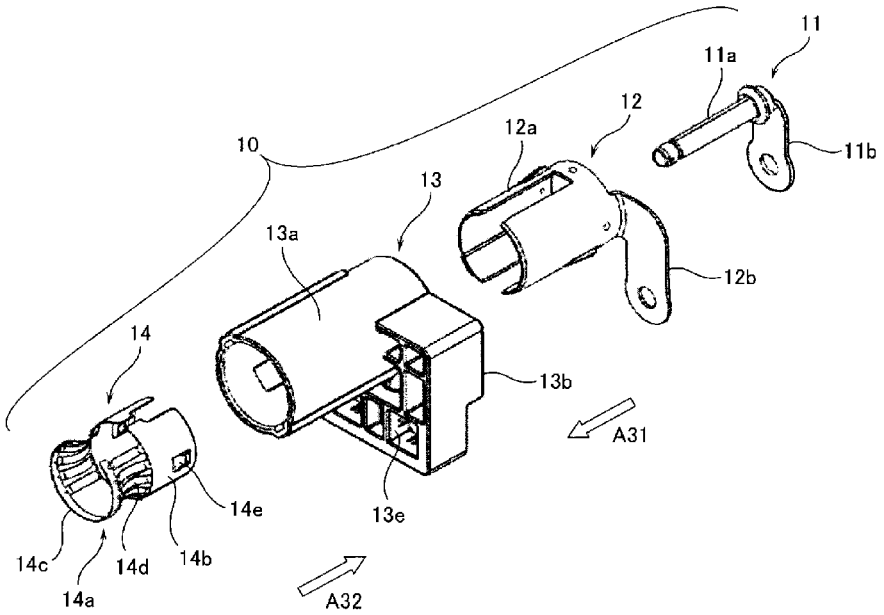
Figure 3B:
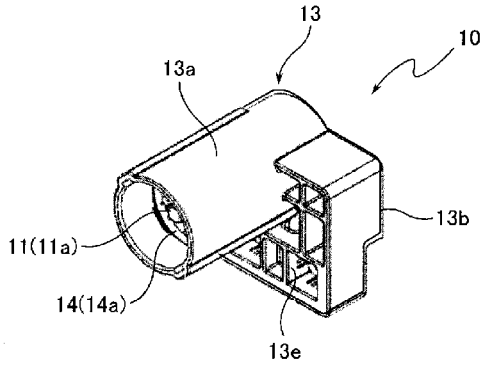
Figure 4:
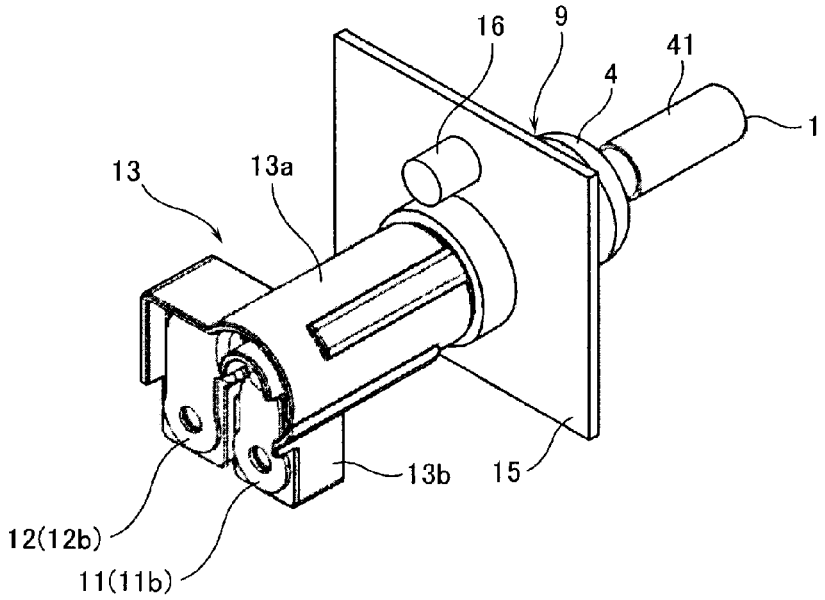
FIG. 4 is a perspective view showing the terminal table and the electric cable in a connected state.

The internal conductor terminal 5 and the external conductor terminal 6 are connected to a terminal member (hereinafter referred to as a terminal table) in the mating appliance to be connected. The electric cable 1 is electrically continued to the mating appliance by way of this terminal table. FIGS. 3A and 3B show an entire structure of the terminal table in the mating appliance, of which FIG. 3A is a perspective view of the terminal table in a state exploded into constituent members, and FIG. 3B is a perspective view showing the entire structure in a state where the constituent members are assembled. FIG. 4 is a perspective view showing a structure in a state where the terminal table is connected to the electric cable 1.

As shown in FIG. 3A, a terminal table 10 includes a first terminal (hereinafter referred to as a terminal table internal terminal) 11 to be connected to the internal conductor terminal 5, a second terminal (hereinafter referred to as a terminal table external terminal) 12 to be connected to the external conductor terminal 6, and a housing member (hereinafter referred to as a terminal table housing) 13 for containing the terminal table internal terminal 11 and the terminal table external terminal 12.

The terminal table internal terminal 11 has an internal terminal part 11*a* which is extended in a cylindrical shape, and an internal terminal contact part 11*b* which is projected in a shape of a flat plate from one end of the internal terminal part 11*a* outwardly in a radial direction. An outer diameter of the internal terminal part 11*a* is set to be slightly smaller than the inner diameter of the opening 52 of the internal conductor terminal 5, and the internal terminal part 11*a* is inserted into the opening 52 thereby to be engaged with the cylindrical part of the opening 52 (See FIG. 2). In this manner, the internal terminal part 11*a* is electrically connected to the internal conductor terminal 5. In a state where the internal terminal contact part 11*b* is contained in the terminal table housing 13 together with the internal terminal part 11*a*, the internal terminal contact part 11*b* is exposed to the exterior from the terminal table housing 13. The internal terminal contact part 11*b* functions as an interface when the internal terminal part 11*a* (that is, the terminal table internal terminal 11) which is connected to the internal conductor terminal 5 is electrically connected to electric wires, bus bars or the like in the mating appliance.

The terminal table external terminal 12 has an external terminal part 12*a* which is formed in a cylindrical shape capable of surrounding an outer periphery of the internal terminal part 11*a* of the terminal table internal terminal 11, and an external terminal contact part 12*b* which is projected in a shape of a flat plate from one end of the external terminal part 12*a* outwardly in a radial direction. An inner diameter of the external terminal part 12*a* is set to be larger than an outer diameter of the internal terminal part 11*a*, and also set to be larger than the largest diameter of the external conductor terminal 6. Accordingly, the external terminal part 12*a* is so constructed as to contain the internal terminal part 11*a* inside its cylindrical shape, and also to contain the internal conductor terminal 5 and the external conductor terminal 6 in a state where the terminal table 10 is connected to the electric cable 1. In a state where the external terminal contact part 12*b* is contained in the terminal table housing 13 together with the internal terminal part 12*a*, the external terminal contact part 12*b* is exposed to the exterior from the terminal table housing 13. The external terminal contact part 12*b* functions as an interface when the external terminal part 12*a* (that is, the terminal table external terminal 12) which is connected to the external conductor terminal 6 is electrically connected to the electric wires, bus bars or the like in the mating appliance.

Moreover, the terminal table external terminal 12 is electrically connected to the external conductor terminal 6 by means of a spring member (hereinafter referred to as an external terminal fixing spring) 14 which is interposed between them. The external terminal fixing spring 14 is formed by folding a conductive elastic material in a shape of a thin plate (for example, a thin sheet metal) into a cylindrical shape, and has a spring part 14*a* for connecting the terminal table external terminal 12 to the external conductor terminal 6, and a fixing part 14*b* for positioning the spring part 14*a* between the terminal table external terminal 12 and the external conductor terminal 6. The spring part 14*a* is provided with a plurality of strip-like spring pieces 14*d* (in other words, slits for forming the spring pieces 14*d*) which are connected by means of a connection part 14*c* in a broken ring shape (a C-shape) at one end in an axial direction, and continued to the fixing part 14*b* at the other end. The spring pieces 14*d* is bridged between the connection part 14*c* and the fixing part 14*b*, and curved in a concave shape in a direction of reducing in diameter, so as to be elastically flexed and deformed. In this manner, the spring part 14*a* is so constructed as to create predetermined elasticity (pressing force) when the spring pieces 14*d* are elastically flexed and deformed. An outer diameter of the fixing part 14*b* is set to be substantially equal to an inner diameter of the terminal table external terminal 12, so that the fixing part 14*b* can be inserted into the terminal table external terminal 12. Moreover, the fixing part 14*b* is provided with a locking part (hereinafter referred to as a spring locking part) 14*e* which is projected in a direction of reducing in diameter. The spring locking part 14*e* is engaged with a support part 13*c* formed in the terminal table housing 13, which will be described below, thereby to position the spring part 14*a* with respect to the terminal table housing 13. In this manner, the spring pieces 14*d* of the spring part 14*a* are positioned between the terminal table external terminal 12 and the external conductor terminal 6 in a manner rightly opposed to both of them.

The terminal table housing 13 has a cylindrical part (hereinafter referred to as a terminal table cylindrical part) 13*a* for containing the terminal table internal terminal 11 and the terminal table external terminal 12, and a holding part 13*b* for holding the internal terminal contact part 11*b* and the external terminal contact part 12*b*. The terminal table cylindrical part 13*a* has an inner diameter which is set to be slightly larger than an outer diameter of the external terminal part 12*a*, and is so constructed as to be engaged with the external terminal part 12*a* of the terminal table external terminal 12 which is inserted from one end in an axial direction (from a direction of an arrow mark A31 in FIG. 3A (corresponding to the above described extreme end side)). Moreover, the terminal table cylindrical part 13*a* has an inner diameter which is set to be larger than an outer diameter of the outer cylindrical part 72, so that interference with the terminal housing 7 may be avoided, when the terminal table 10 is connected to the electric cable 1, as described below. Further, the terminal table cylindrical part 13*a* is provided with the support part 13*c* for supporting the internal terminal part 11*a* of the terminal table internal terminal 11 which is inserted from the direction A31 in the same manner as the internal terminal part 12*a*. In this case, the support part 13*c* supports the internal terminal part 11*a* in a state where a projection 13*d* projecting inwardly in a radial direction is butted against an outer peripheral face of the internal terminal part 11*a*. At the same time, the support part 13*c* is engaged with the spring locking part 14*e* of the external terminal fixing spring 14 which is inserted from the other end in the axial direction (from a direction of an arrow mark A32 in FIG. 3A (corresponding to the above described base end side)) thereby to support the fixing part 14*b*. In other words, the support part 13*c* supports the external terminal part 12*a* by way of the external terminal fixing spring 14. In this manner, the terminal table internal terminal 11 and the terminal table external terminal 12 are integrally assembled to the terminal table cylindrical part 13*a*. On this occasion, the terminal table housing 13 is brought into such a state that the terminal table internal terminal 11 and the terminal table external terminal 12 are coaxially arranged and separated by the support part 13*c*, all of which are contained in the terminal table cylindrical part 13*a*. Specifically, in a state contained in the terminal table housing 13, the terminal table internal terminal 11 and the terminal table external terminal 12 are arranged in a manner separated at a constant interval. The holding part 13*b* is a frame-like body which is projected from an outer peripheral face of the terminal table cylindrical part 13*a*, and reinforced with ribs 13*e* which are provided in a shape of a lattice. In a state where the terminal table internal terminal 11 and the terminal table external terminal 12 are integrally assembled to the terminal table cylindrical part 13*a*, this holding part 13*b* holds them, by bringing the internal terminal contact part 11*b* and the external terminal contact part 12*b* into contact with the ribs 13*e*.

The terminal table 10 in which the terminal table internal terminal 11 and the terminal table external terminal 12 are integrally assembled to the terminal table housing 13 as described above is connected to the electric cable 1. Specifically, the internal terminal part 11*a* of the terminal table internal terminal 11 is connected to the internal conductor terminal 5, and the external terminal part 12*a* of the terminal table external terminal 12 is connected to the external conductor terminal 6. On this occasion, by engaging the electric cable 1 with the terminal table 10 in such a manner that a distal end part (an end part at the extreme end side (a left end part in FIG. 2)) of the inner cylindrical part 71 of the terminal housing 7 is butted against the projection 13*d* of the support part 13*c* of the terminal table housing 13, it is possible to position the internal terminal part 11*a* with respect to the internal conductor terminal 5, and the external terminal part 12*a* with respect to the external conductor terminal 6, respectively in a connected state. Then, the internal terminal contact part 11*b* of the terminal table internal terminal 11 which is connected to the internal conductor terminal 5, and the external terminal contact part 12*b* of the terminal table external terminal 12 which is connected to the external conductor terminal 6 are respectively connected to the electric wires or bus bars in the mating appliance. In this manner, the terminal table 10 performs electrical continuity between the electric cable 1 and the mating appliance. It is to be noted that the electric cable 1 which is connected to the terminal table 10 is fixed to a fixing member 15 of the mating appliance via the shield shell 9 by means of a fixing member 16 such as a screw (See FIG. 4).

As described above, according to the terminal connection structure for the electric cable in this embodiment, it is possible to coaxially arrange the internal conductor terminal 5 and the external conductor terminal 6 in a separated manner, and hence, it is possible to achieve downsizing of the terminal connection part of the electric cable 1 including the internal conductor terminal 5, the external conductor terminal 6, the terminal housing 7, and so on. Moreover, following the downsizing of the terminal connection part, it is possible to reduce the number of fixing points of the internal conductor terminal 5, the external conductor terminal 6, the terminal housing 7 and so on, and hence, it is possible to achieve enhancement of assembling work of these members, and connecting work with respect to the mating appliance. In addition, because a plurality of the terminals (for example, the internal conductor terminal 5 and the external conductor terminal 6) can be coaxially arranged at a constant interval, it is possible to easily perform the impedance matching thereby to enhance electrical continuity performance. Moreover, in the terminal table 10 according to this embodiment, because the terminal table internal terminal 11 and the terminal table external terminal 12 can be coaxially arranged in a separated manner, it is also possible to downsize the terminal connection part of the mating appliance, by using the terminal table 10 in connecting the electric cable 1 to the mating appliance. As the results, it is possible to achieve further downsizing of the terminal connection part of the electric cable 1.

Now, features of the terminal connection structure for the electric cable in the embodiment according to the invention will be briefly summarized and itemized in the following items [1] to [2].

[1] A terminal connection structure for an electric cable 1 which includes an internal conductor 2 covered with a first insulating covering 21, and an external conductor 3 surrounding an outer periphery of the first insulating covering 21 and covered with a second insulating covering 31 coaxially with the internal conductor 2, the terminal connection structure being connected respectively to the internal conductor 2 and the external conductor 3, wherein the terminal connection structure includes a first terminal 5 which is connected to a part of the internal conductor 2 which is exposed by peeling off the first insulating covering 21, a second terminal 6 having a cylindrical shape surrounding an outer periphery of the first terminal 5 and connected to a part of the external conductor 3 which is exposed by peeling off the second insulating covering 31, and a housing member 7 which surrounds an outer periphery of the first terminal 5 and an outer periphery of the second terminal 6, and contains the first terminal 5 and the second terminal 6 coaxially in a separated manner.

[2] A terminal connection structure for an electric cable having the structure as described above in [1], which includes a shield conductor 4 surrounding an outer periphery of the second insulating covering 31 and covered with a third insulating covering 41 coaxially with the internal conductor 2 and the external conductor 3, and a shield member 9 connected to a part of the shield conductor 4 which is exposed by peeling off the third insulating covering 41, wherein the shield member 9 surrounds an outer periphery of the housing member 7, and the exposed part of the shield conductor 4 is arranged on an outer periphery of the shield member 9, and connected by press-fitting to an outer peripheral face of the shield member 9 by means of a ring member 33 which is covered on an outer periphery of the exposed part.

According to the terminal connection structure for the electric cable of the invention, it is possible to achieve downsizing of the terminal connection part of the electric cable (coaxial cable), and at the same time, it is possible to achieve enhancement of connection workability and electrical continuity performance.

What is claimed is:

1. A terminal connection structure for an electric cable which includes an internal conductor covered with a first insulating covering, and an external conductor surrounding an outer periphery of the first insulating covering and covered with a second insulating covering, the external conductor being arranged coaxially with the internal conductor, the terminal connection structure being connected respectively to the internal conductor and the external conductor, the terminal connection structure comprising:

a first terminal connected to a part of the internal conductor which is exposed by peeling off the first insulating covering;

a second terminal having a cylindrical shape surrounding an outer periphery of the first terminal and connected to a part of the external conductor which is exposed by peeling off the second insulating covering;

a housing member that surrounds the outer periphery of the first terminal and an outer periphery of the second terminal, and contains the first terminal and the second terminal which are arranged coaxially in a separated manner;

a shield conductor surrounding an outer periphery of the second insulating covering and covered with a third insulating covering, the shield conductor being arranged coaxially with the internal conductor and the external conductor; and a shield member connected to a part of the shield conductor which is exposed by peeling off the third insulating covering, wherein the shield member surrounds an outer periphery of the housing member; and wherein the exposed part of the shield conductor is arranged on an outer periphery of the shield member, and the exposed part of the shield conductor is connected by press-fitting to an outer peripheral face of the shield member by a ring member which is covered on an outer periphery of the exposed part of the shield conductor.

* * * * *